US010471324B2

(12) United States Patent
Torres

(10) Patent No.: US 10,471,324 B2
(45) Date of Patent: Nov. 12, 2019

(54) SPORTS TRAINING DEVICE APPARATUS

(71) Applicant: Luis R. Torres, Fleming Island, FL (US)

(72) Inventor: Luis R. Torres, Fleming Island, FL (US)

( * ) Notice: Subject to any disclaimer, the term of this patent is extended or adjusted under 35 U.S.C. 154(b) by 0 days.

(21) Appl. No.: 15/848,547

(22) Filed: Dec. 20, 2017

(65) Prior Publication Data

US 2018/0169496 A1 Jun. 21, 2018

Related U.S. Application Data

(60) Provisional application No. 62/437,228, filed on Dec. 21, 2016.

(51) Int. Cl.
*A63B 69/00* (2006.01)
*A63B 63/00* (2006.01)

(52) U.S. Cl.
CPC ..... *A63B 69/002* (2013.01); *A63B 63/004* (2013.01); *A63B 69/0097* (2013.01); *A63B 2209/10* (2013.01); *A63B 2243/0025* (2013.01)

(58) Field of Classification Search
CPC . A63B 69/002; A63B 63/004; A63B 69/0097; A63B 2243/0025; A63B 63/003; A63B 2024/0046; A63B 24/0021
USPC ..... 473/446, 422, 476–478, 434, 435, 438, 473/451, 455
See application file for complete search history.

(56) References Cited

U.S. PATENT DOCUMENTS 2,126,102 A 8/1938 Fowler
3,312,467 A * 4/1967 Dawson ..... A63B 69/0002 473/454
3,583,703 A * 6/1971 Brown ..... A63B 63/00 473/456
3,997,158 A * 12/1976 Britton ..... A63B 63/00 473/454
4,473,227 A * 9/1984 Klaus ..... A63B 63/00 473/454
5,271,624 A * 12/1993 Sciortino ..... A63B 63/004 473/446
5,348,291 A * 9/1994 Scully ..... A63B 63/00 473/454

(Continued)

FOREIGN PATENT DOCUMENTS

DE 8226423 U1 2/1983
WO 2007135456 A1 11/2007

OTHER PUBLICATIONS

International Search Report dated Mar. 12, 2018 in Application Serial No. PCT/US2017/067570.

(Continued)

*Primary Examiner* — Mitra Aryanpour

(74) *Attorney, Agent, or Firm* — Michael T. Abramson; Holland & Knight LLP

(57) ABSTRACT

A sports training apparatus including a flexible bistable spring band, wherein the flexible bistable spring band may have two stable mechanical states. The sports training apparatus may further include an elastic band including a first end and a second end, wherein a first end of the elastic band may be configured to be removeably attached to the flexible bistable spring band. The flexible bistable spring band may transition from a first stable mechanical state to a second stable mechanical state by wrapping around a cylindrical object.

13 Claims, 8 Drawing Sheets

(56) References Cited

U.S. PATENT DOCUMENTS 5,351,948 A * 10/1994 Thomas ..... A63B 63/00 473/417
5,433,434 A * 7/1995 Helmetsie ..... A63B 63/00 473/446
5,511,775 A * 4/1996 Parks ..... A63B 63/00 473/454
5,584,481 A * 12/1996 Caluori ..... A63B 69/0026 473/446
6,402,641 B1 * 6/2002 Lee ..... A63B 63/00 473/446
6,716,122 B2 * 4/2004 Vermeulen ..... A63B 63/004 473/476
7,198,274 B2 * 4/2007 Cho ..... A63B 63/004 473/454
7,407,452 B1 8/2008 Gawthrop
7,455,603 B2 * 11/2008 Bouffard ..... A63B 63/004 473/478
7,833,140 B2 * 11/2010 Ligrano ..... A63B 21/00043 482/124
8,602,919 B2 * 12/2013 Bishop ..... A63B 63/00 473/421
8,905,870 B1 * 12/2014 Stafford ..... A63B 69/0002 473/454
9,345,922 B2 * 5/2016 Allison ..... A63B 21/0442 482/904
2003/0228941 A1 12/2003 Bains
2009/0181810 A1 * 7/2009 Stephenson ..... A63B 63/004 473/446
2011/0212797 A1 * 9/2011 Adkins ..... A63B 69/0002 473/451
2012/0046133 A1 2/2012 Pettys et al.
2015/0196819 A1 * 7/2015 Markham ..... A63B 71/0622 473/446
2016/0174668 A1 6/2016 Script
2018/0169496 A1 * 6/2018 Torres ..... A63B 69/002 473/446

OTHER PUBLICATIONS

Idge01 . "How to Set Up and Take Down Your Targetizer." YouTube, YouTube, May 9, 2012. 0:07-0:08, 0:18-0:27, 0:30-0:35, 0:40-0:42, 1:58-2:04; www.youtube.com/watch?v=GZa6waTsacl.

* cited by examiner

10

10

10

10

10

10

10

SPORTS TRAINING DEVICE APPARATUS

RELATED CASES

This application claims the benefit of U.S. Provisional Application No. 62/437,228, filed on 21 Dec. 2016, the contents of which are all incorporated by reference.

BACKGROUND

To help train and better oneself at a sport/activity, it may be beneficial to use one or more training devices. For example, when training for soccer, cover systems may be used to decrease the size of the goal, thereby forcing the shooter to better learn to make more accurately aimed shots. Generally, such training devices tend to be bulky and onerous, which may result in more time required for installing its use (e.g., up to 20 min to install and remove). Moreover, with these types of training devices (e.g., metal and/or full cover systems), the soccer balls may rebound, go into a basket, or behind the cover making ball retrieval difficult and time consuming, and such training devices may entangle, distract, and endanger the goalkeeper. Additionally, such training devices tend to be expensive, and have a rigid "one size fits all" singular configuration for use.

BRIEF SUMMARY OF DISCLOSURE

In one example implementation, a sports training apparatus may include but is not limited to a flexible bistable spring band, wherein the flexible bistable spring band may have two stable mechanical states. The sports training apparatus may further include an elastic band including a first end and a second end, wherein a first end of the elastic band may be configured to be removeably attached to the flexible bistable spring band. The flexible bistable spring band may transition from a first stable mechanical state to a second stable mechanical state by wrapping around a cylindrical object.

One or more of the following example features may be included. The flexible bistable spring band may include a loop and hook fastener system. The first end of the elastic band may be configured to removeably attach to the flexible bistable spring band via a removable clip. The sports training apparatus may further include an extender strap that may include a first end and a second end. The second end of the elastic band may be configured to removeably attach to a first end of the extender strap. The second end of the extender strap may be configured to removeably attach to a second flexible bistable spring band. The sports training apparatus may further include a second elastic band that may include a first end and a second end. The first end of the second elastic band may be configured to removeably attach to the first end of the extender strap. The first end of the second elastic band may be configured to removeably attach to a second flexible bistable spring band. A second end of the second elastic band may be configured to removeably attach to a ground stake. The sports training apparatus may further include a strap, wherein the strap may be configured to removeably attach to at least a third and a fourth flexible bistable spring band, and may include a plurality of loops individually configured to removeably attach to a second end of the elastic band. The sports training apparatus may further include a strap, wherein the strap may be configured to removeably attach to at least a third and a fourth flexible bistable spring band, and may include a plurality of loops individually configured to removeably attach to an end of a second elastic band. The cylindrical object may include a goal post. A second end of the elastic band may be configured to removeably attach to a mini-goal within a larger goal.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

The Sports Training Device:

As discussed above and referring also at least to the example implementations of FIGS. 1-6, a sports training apparatus, such as example sports training apparatus 10, may include but is not limited to, a flexible bistable spring band, wherein the flexible bistable spring band may have two stable mechanical states. The sports training apparatus may further include an elastic band including a first end and a second end, wherein a first end of the elastic band may be configured to be removeably attached to the flexible bistable spring band. The flexible bistable spring band may transition from a first stable mechanical state to a second stable mechanical state by wrapping around a cylindrical object.

Figure 1A:
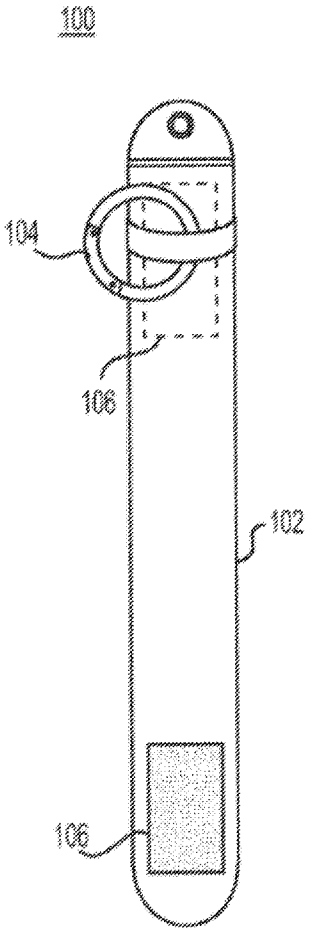
FIGS. 1*a-c* are example diagrammatic views of elements of a sports training device according to one or more example implementations of the disclosure.

In some implementations, a sports training apparatus, such as example sports training apparatus 10, may include but is not limited to, a flexible bistable spring band, wherein the flexible bistable spring band may have two stable mechanical states. In some implementations, the flexible bistable spring band (e.g., spring band 100) may be similar to known so-called "snap bracelets," which may be a layered, flexible stainless steel bistable spring bands sealed within a fabric, silicone, or plastic cover 102. It will be appreciated that a similar band made from different materials may also be used without departing from the scope of the disclosure. Spring band 100 may have two stable mechanical shapes, particularly where the shapes are stabilized by different curvature axes. For instance, the first stable mechanical shape may be a straightened shape, as is shown in FIG. 1*a*. The second mechanical shape (as shown in other figures) is curved, such that spring band 100 wraps around a cylindrical object (e.g., a goal post) upon sufficient force by a user hitting spring band 100 around the cylindrical object, to thereby transition to the second mechanical shape.

In some implementations, the flexible bistable spring band may include a loop and hook fastener system. For example, spring band 100 may include hook and loop fasteners (such as fasteners 106), e.g., on opposite ends and opposite sides of spring band 100, that may contact each other when in the second stable mechanical shape (i.e., wrapped around the cylindrical object). As a result, removing spring band 100 from the cylindrical object may require more force than if fasteners 106 were not present, which may be a desired trait to keep spring band 100 from accidentally slipping off of the cylindrical object. It will be appreciated that fasteners 106 may include other types of fasteners, including but not limited to, e.g., magnets, snap buttons, or other appropriate fastener.

In some implementations, spring band 100 may include a loop (e.g., nylon or other suitable material loop), which may be configured to receive a clip, such as clip 104. Clip 104 may be a carabiner or other suitable clip that allows the clip to be opened and closed.

Figure 1B:
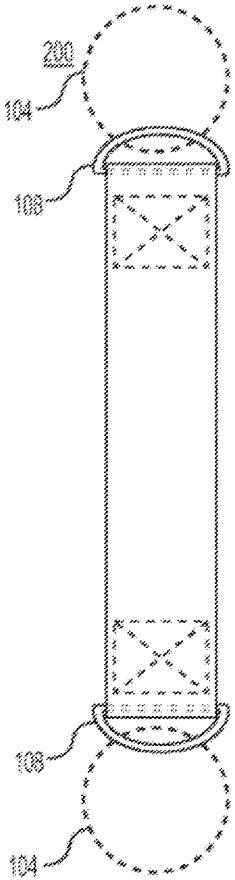

In some implementations, and referring at least to FIG. 1*b*, sports training apparatus 10 may further include an elastic band (e.g., elastic band 200) that may include a first end and a second end, wherein the first end of the elastic band may be configured to be removeably attached to the flexible bistable spring band (e.g., spring band 100). For example, elastic band 200 may have its ends folded over and secured (e.g., stitched), such that a ring (e.g., ring 108) may be stitched into it. In some implementations, ring 108 may be a D-ring, however, it will be appreciated that other types of rings, including clip 104, may also be used without departing from the scope of the disclosure. In the example, by using clip 104 and ring 108, one end of spring band 100 may be removeably attached to elastic band 200.

Figure 1C:
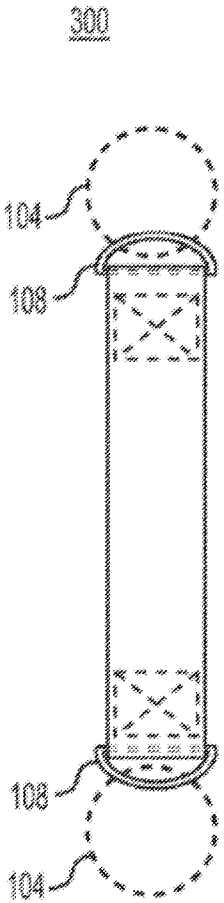
Figure 2:
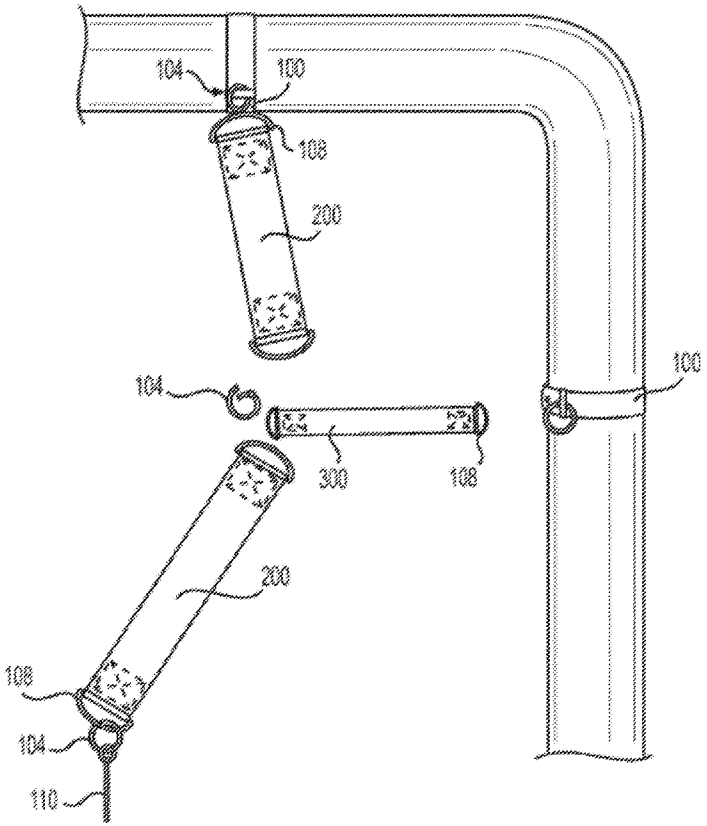
FIG. 2 is an example diagrammatic view of a sports training device according to one or more example implementations of the disclosure.
Figure 3:
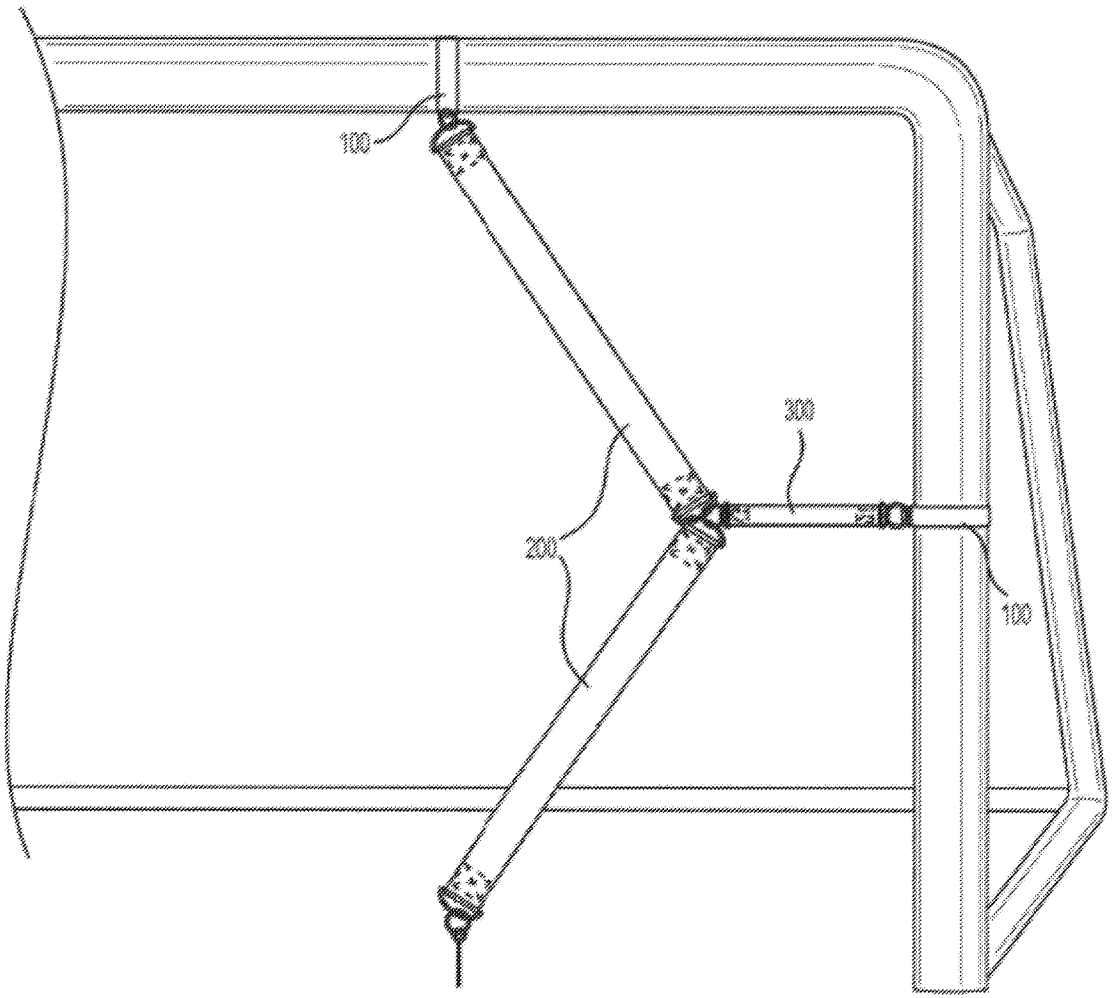
FIG. 3 is an example diagrammatic view of a sports training device according to one or more example implementations of the disclosure.

In some implementations, and referring at least to FIG. 1*c*, sports training apparatus 10 may further include an extender strap (e.g., strap 300) that may include a first end and a second end. The second end of the elastic band (e.g., elastic band 200) may be configured to removeably attach to a first end of the extender strap. For example, similar to elastic band 200, example, strap 300 may have its ends folded over and secured (e.g., stitched), such that a ring (e.g., ring 108) may be stitched into it. In some implementations, ring 108 may be a D-ring, however, it will be appreciated that other types of rings, including clip 104, may also be used without departing from the scope of the disclosure. In the example, by using clip 104 and ring 108, one end of strap 300 may be removeably attached to, e.g., elastic band 200, spring band 100, as well as other combinations as will be discussed below.

For example, in some implementations, there may be multiple combinations and numbers of elastic bands 200, spring bands 100, and/or straps 300. For instance, the second end of strap 300 may be configured to removeably attach to a second flexible bistable spring band, as shown at least in the example implementation of FIGS. 2-3. As another example at least shown in FIGS. 2-3, in some implementations, sports training apparatus 10 may further include a second elastic band that may include a first end and a second end, where the first end of the second elastic band may be configured to removeably attach to the first end of the extender strap (e.g., strap 300), and the first end of the second elastic band may be configured to removeably attach to the second flexible bistable spring band. As yet another example, and still referring at least to FIG. 2, a second end of the second elastic band may be configured to removeably attach to ground stake 110 (e.g., similar to a tent stake, or an eye bolt, or other appropriate item that allows for securing elastic band 200 to the ground). As another example to show the many combinations of and numbers of elastic bands 200, spring bands 100, and/or straps 300, an essential doubling of the implementation of FIG. 3 may be used, with one on both sides of the goal. That is, sports training apparatus 10 may further include a second strap 300, wherein the second strap may be configured to removeably attach to a third and a fourth spring band (e.g., via clip 104, ring 108, or combination thereof).

Figure 4:
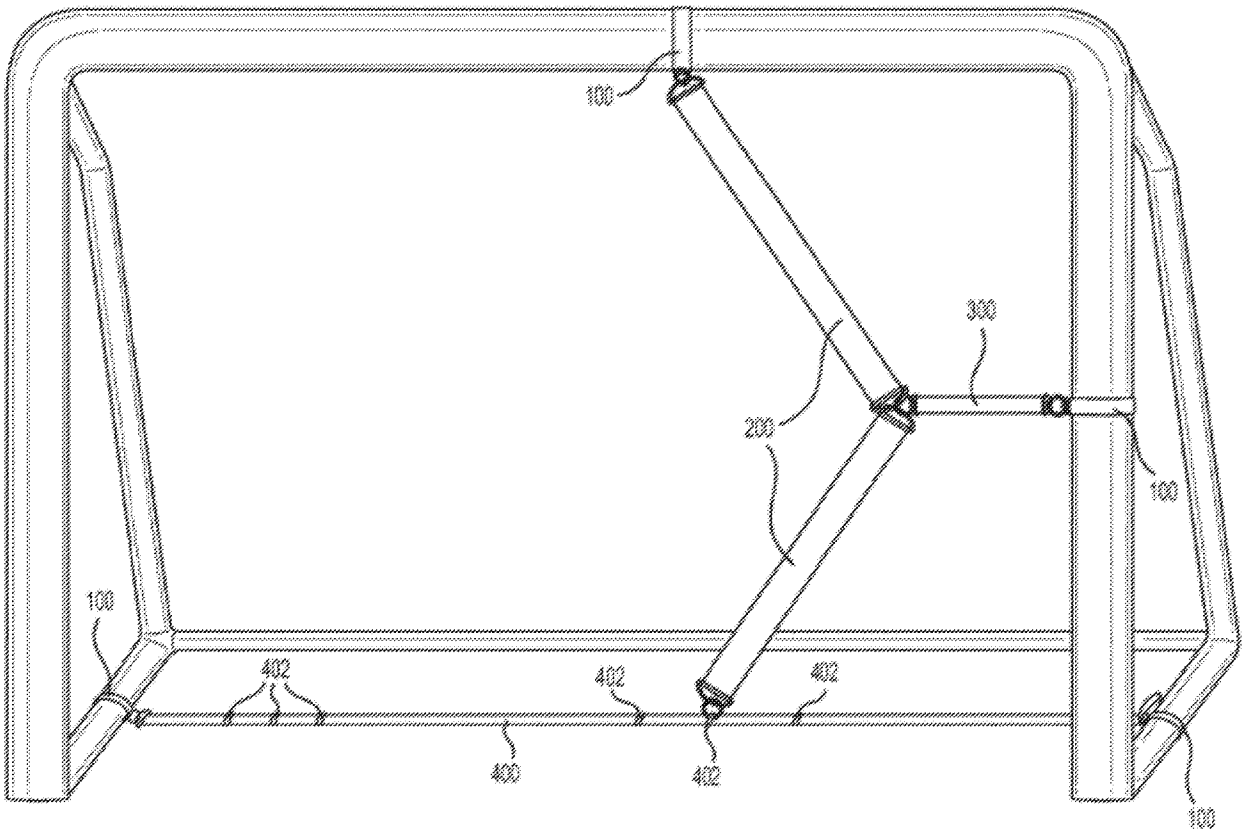
FIG. 4 is an example diagrammatic view of a sports training device according to one or more example implementations of the disclosure.
Figure 5:
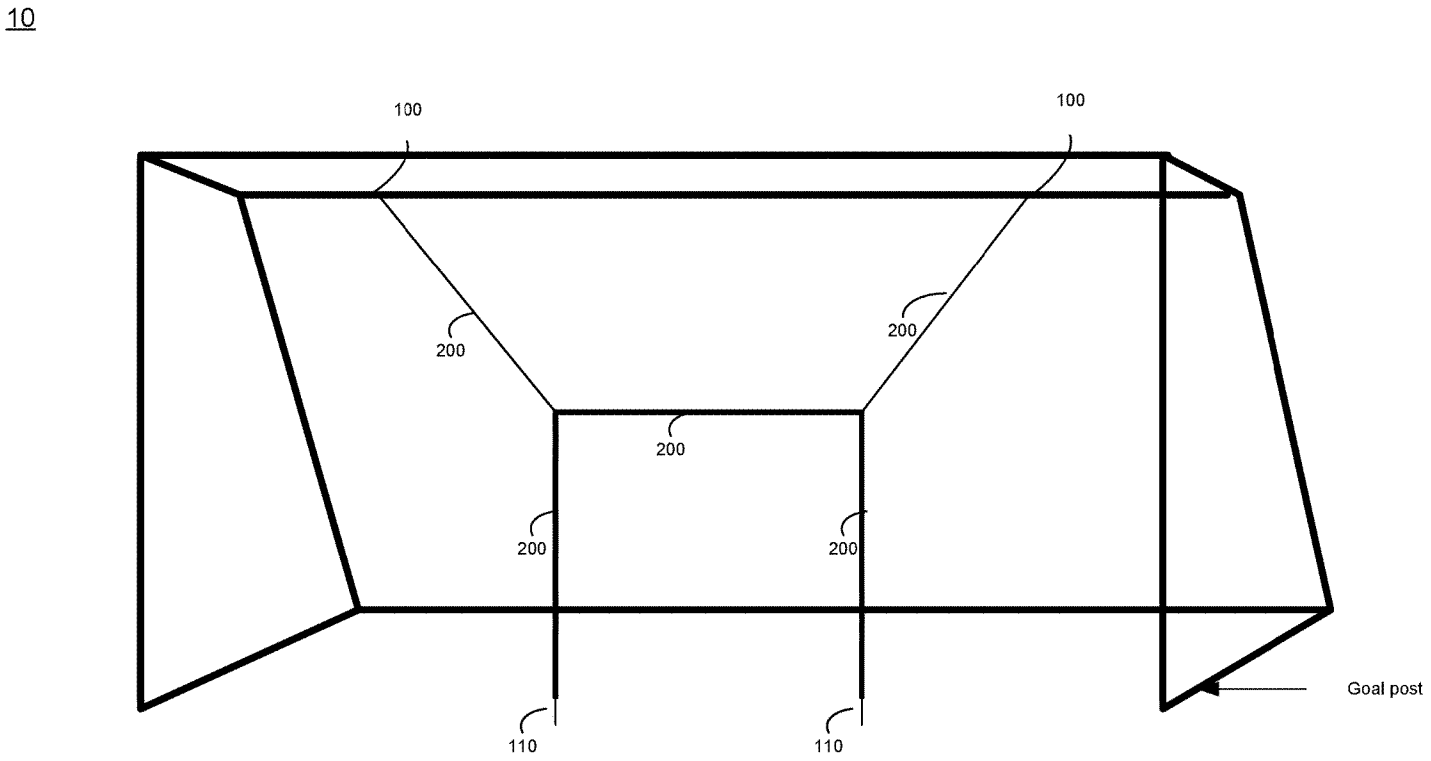
FIG. 5 is an example diagrammatic view of a sports training device according to one or more example implementations of the disclosure.

As another example, and referring at least to the example implementation of FIG. 4, a version of sports training apparatus 10 that may be used indoors is shown. For example, in situations where stake 110 cannot be driven into the ground (e.g., inside a gymnasium) sports training apparatus 10 may include a nylon or elastic strap (e.g., strap 400) that may include a plurality of loops (e.g., nylon loops such as loops 402) individually configured to removeably attach to a second end of the elastic band. Loops 402 may be secured (e.g., sewn) to strap 400 at various lengths, or may be moveable, to allow for different lower angles. As such, the example implementation of FIG. 4 may provide a similar "feel" as the implementation of FIGS. 2-3 where stakes are used.

It will be appreciated that while certain lengths of spring band 100 (e.g., 15"), elastic band 200 (e.g., 3'), and strap 300 (e.g., 12") may be used, other lengths may be used without departing from the scope of the disclosure. As such, the specific lengths used should be taken as example only and not to otherwise limit the scope of the disclosure.

In some implementations, a second end of the elastic band may be configured to removeably attach to a mini-goal within a larger goal. For example, and referring at least to the example implementation of FIG. 5, an example of sports training apparatus 10 used to create a smaller (mini) goal is shown. In the example, elastic band 200 may be similarly secured to the goal via spring band 100 (as discussed above), but instead of the other end of elastic band 200 being removeably attached to strap 300, for example, elastic band 200 may be removeably attached to other elastic straps to create a smaller goal. In the example, the elastic straps making up the smaller goal may be stretched to adjust the size of the smaller goal, and one of the elastic straps may be secured to the above-noted eye bolt 110, as discussed above and shown at least in FIG. 2. Thus, an inexpensive mini-goal may be quickly attached for, e.g., small sided games, to better hone scoring accuracy, etc.

Figure 6:
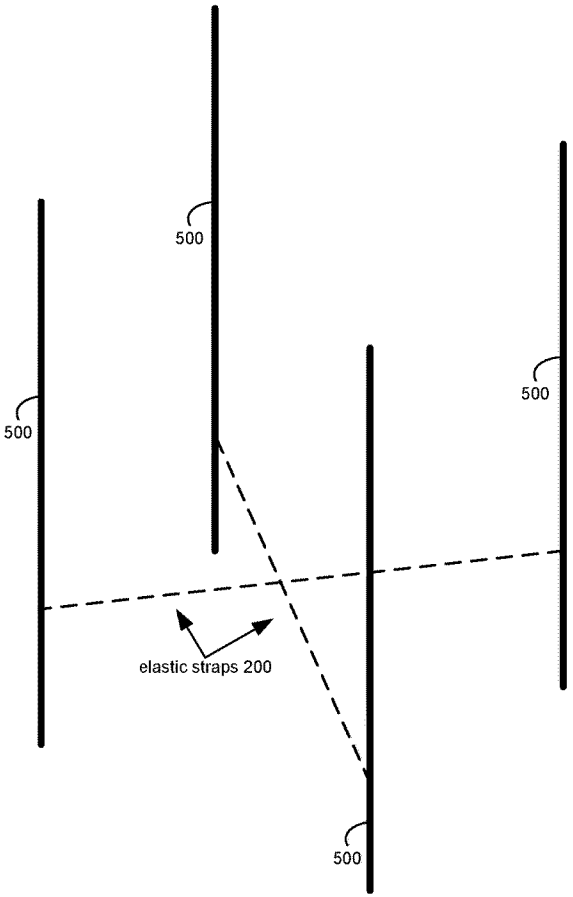
FIG. 6 is an example diagrammatic view of a sports training device according to one or more example implementations of the disclosure.

In some implementations, and referring at least to the example implementation of FIG. 6, an example of sports training apparatus 10 is shown that may be used to create a systems for ploy metric and agility training, as well as for various games such as soccer tennis, chipping, low-ball, etc. In the example, poles or sticks (e.g., poles 500) may be secured into the ground, and elastic straps 200 may be secured to them, similarly as discussed above with securing elastic straps 200 to the goal or via clip 104/ring 108. Thus, sports training apparatus may be used in a number of different ways and as a number of different training devices.

It will be appreciated that while the disclosure includes an example of a soccer goal, other uses are also contemplated. For example, sports training apparatus 10 may be used with, e.g., Soccer, Futsal, Lacrosse, Hockey, Handball, etc. Thus, sports training apparatus 10 may provide an extremely versatile, flexible, simple, easy to use, quick and inexpensive way to isolate the areas of a goal or other object, thereby helping to train and improve accuracy and scoring. Sports training apparatus 10 is thus easier and quicker to install and remove than known training devices. Moreover, as noted above, there are countless angles, sizes of angles (e.g., by moving the spring band straps left and right on the goal crossbar and up and down on the goal post) and configurations that may be attained by just moving the spring band(s) holders, and/or adding extender straps. The corner marking implementation enables the elastic bands to stretch and contract to different sizes, and may be safe if contacted by the goalie or other user. This may be important because the training may become realistic, functional, impactful, as the visualization of the corner areas becomes imprinted in the players mind. Thus, sports training apparatus 10 is unlike other training devices that either go across and/or cover the entire front of the goal, or are made primarily of metals which may entangle and endanger the goalkeeper.

Additionally, sports training apparatus 10 may allow for the balls to move right through if they are hit, rather than with other metal and full cover systems where the balls may rebound or go into a basket or behind the cover which may make ball retrieval difficult and time consuming.

The terminology used herein is for the purpose of describing particular implementations only and is not intended to be limiting of the disclosure. As used herein, the singular forms "a", "an" and "the" are intended to include the plural forms as well, unless the context clearly indicates otherwise. As used herein, the language "at least one of A, B, and C" (and the like) should be interpreted as covering only A, only B, only C, or any combination of the three, unless the context clearly indicates otherwise. It will be further understood that the terms "comprises" and/or "comprising," when used in this specification, specify the presence of stated features, integers, steps (not necessarily in a particular order), elements, and/or components, but do not preclude the presence or addition of one or more other features, integers, steps (not necessarily in a particular order), elements, components, and/or groups thereof.

The corresponding structures, materials, acts, and equivalents that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. A sports training apparatus comprising:

a first flexible bistable spring band, wherein the first flexible bistable spring band includes a loop and hook fastener system, and wherein the first flexible bistable spring band has two stable mechanical states;

a first removeable clip and a second removable clip;

a first elastic band including a first end and a second end, wherein the first end of the first elastic band is configured to removeably attach to the first flexible bistable spring band via the first removeable clip;

a second flexible bistable spring band, wherein the second flexible bistable spring band has two stable mechanical states;

a second elastic band including a first end and a second end, wherein the first end of the second elastic band is configured to removeably attach to the second flexible bistable spring band via the second removeable clip; and wherein the first flexible bistable spring band transitions from a first stable mechanical state to a second stable mechanical state by wrapping around a cylindrical object, and wherein the first end of the first elastic band is configured to removeably attach to the first flexible bistable spring band while the first flexible bistable spring band is in the second stable mechanical state wrapped around the cylindrical object, and wherein the second flexible bistable spring band transitions from a first stable mechanical state to a second stable mechanical state, and wherein the first end of the second elastic band is configured to removeably attach to the second flexible bistable spring band while the second flexible bistable spring band is in the second stable mechanical state.

2. The sports training apparatus of claim 1 further comprising an extender strap, the extender strap including a first end and a second end.

3. The sports training apparatus of claim 2 wherein the second end of the first elastic band is configured removeably attach to a first end of the extender strap.

4. The sports training apparatus of claim 2 wherein the second end of the extender strap is configured to removeably attach to the second flexible bistable spring band.

5. The sports training apparatus of claim 1 wherein the first end of the second elastic band is configured to removeably attach to the first end of the extender strap.

6. The sports training apparatus of claim 1 wherein the second end of the second elastic band is configured to removeably attach to a ground stake.

7. The sports training apparatus of claim 1 further comprising a strap, wherein the strap is configured to removeably attach to at least a third and a fourth flexible bistable spring band, and includes a plurality of loops individually configured to removeably attach to the second end of the elastic band.

8. The sports training apparatus of claim 1 further comprising a strap, wherein the strap is configured to removeably attach to at least a third and a fourth flexible bistable spring band, and includes a plurality of loops individually configured to removeably attach to one of the first end and the second end of the second elastic band.

9. The sports training apparatus of claim 1 wherein the cylindrical object includes a goal post.

10. The sports training apparatus of claim 1 wherein the second end of the first elastic band is configured to removeably attach to a mini-goal within a larger goal.

11. A sports training apparatus comprising:

a first flexible bistable spring band, wherein the first flexible bistable spring band includes a loop and hook fastener system, and wherein the first flexible bistable spring band has two stable mechanical states;

a first removeable clip and a second removable clip;

a second flexible bistable spring band, wherein the second flexible bistable spring band has two stable mechanical states;

an elastic band including a first end and a second end, wherein a first end of the elastic band is configured to removeably attach to the first flexible bistable spring band via the first removeable clip, and wherein a second end of the elastic band is configured to removeably attach to the second flexible bistable spring band via the second removable clip; and wherein the first flexible bistable spring band transitions from a first stable mechanical state to a second stable mechanical state by wrapping around a cylindrical object, and wherein the second flexible bistable spring band transitions from a first stable mechanical state to a second stable mechanical state by wrapping around one of the cylindrical object and a second cylindrical object.

12. The sports training apparatus of claim 1 wherein the first flexible bistable spring band includes a loop coupled to a portion of the first flexible bistable spring band.

13. The sports training apparatus of claim 12 wherein the loop attached to a portion of the first bistable spring band is configured to receive the first removeable clip to removeably attach to the first end of the elastic band.

* * * * *